United States Patent [19]

Okuyama et al.

[11] Patent Number: 4,725,763

[45] Date of Patent: Feb. 16, 1988

[54] CONVERGENCE CORRECTING DEVICE CAPABLE OF COMA CORRECTION FOR USE IN A CATHODE RAY TUBE HAVING IN-LINE ELECTRON GUNS

[75] Inventors: Nobutaka Okuyama; Toshiharu Shimizu; Hiroki Oguro, all of Yokohama, Japan

[73] Assignee: Hitachi, Ltd., Tokyo, Japan

[21] Appl. No.: 911,422

[22] Filed: Sep. 25, 1986

[30] Foreign Application Priority Data

Sep. 27, 1985 [JP] Japan ..... 60-212415
May 28, 1986 [JP] Japan ..... 61-121038

[51] Int. Cl.[4] ..... H01J 29/70; H01J 29/50
[52] U.S. Cl. ..... 315/368; 313/412
[58] Field of Search ..... 315/368; 313/412

[56] References Cited

U.S. PATENT DOCUMENTS 3,325,675 6/1967 Sanford ..... 313/412
4,410,840 10/1983 Beeteson ..... 315/368

*Primary Examiner*—Theodore M. Blum
*Assistant Examiner*—Gregory C. Issing
*Attorney, Agent, or Firm*—Antonelli, Terry & Wands

[57] ABSTRACT

A convergence correcting device for correcting misconvergence of a cathode ray tube having in-line electron guns and, at the same time, correcting coma at the top and bottom of the screen, the device comprising pole pieces provided for the outermost electron beams for producing 4-pole magnetic fields used for convergence correction, a convergence yoke for applying the magnetic fields to the pole pieces, a convergence coil wound on the convergence yoke, a coil for producing a coma correcting magnetic field which cancels a leakage flux created between the right and left pole pieces by the vertical deflection coil, and current sources for supply currents to the coils.

10 Claims, 22 Drawing Figures

CONVERGENCE CORRECTING DEVICE CAPABLE OF COMA CORRECTION FOR USE IN A CATHODE RAY TUBE HAVING IN-LINE ELECTRON GUNS

BACKGROUND OF THE INVENTION

This invention relates to a convergence correcting device used in a cathode ray tube having coplanar in-line electron guns for producing multiple electron beams. The invention particularly relates to a convergence correcting device capable of coma correction.

The convergence correcting device for a cathode ray tube having in-line electron guns operates in such a way that an external magnetic field is applied to pole pieces provided for the electron guns and the electron beams between the pole pieces are rendered a deflection force through the adjustment of the direction and magnitude of the magnetic field.

FIG. 1 shows a cathode ray tube having in-line electron guns seen from above. The cathode ray tube 1 consists of a set of in-line electron guns 2, a neck section 3 surrounding the electron guns 2, convergence yokes 4, convergence coils 5, pole pieces 6 made of magnetic material, and deflection coil 7 for deflecting the electron beams in the horizontal and vertical directions. The arrows 8 indicate a leakage flux derived from the deflection coil 7. Electron beams emitted from the electron guns 2 have their trajectories corrected by a convergence correcting device made up of the yokes 4, coils 5 and pole pieces 6 so that they converge to a point on a shadow mask (not shown) behind of the screen.

FIG. 2 is a cross-sectional view of the neck section 3 taken along the line II—II of FIG. 1. With a current supplied to the convergence coils 5, the yokes 4 produce a magnetic field, which passes through the pole pieces 6 arranged at the neck section 3 of the tube 1 in close vicinity to the yokes 4, and magnetic paths shown by the dashed lines are formed. Accordingly, perpendicular magnetic fields are produced between the upper and lower pole pieces 6 as shown. The electron beams B and R in the magnetic fields are rendered a horizontal deflection force in proportion to the magnitude of the magnetic fields. The deflection force is used to move the vertical rasters 1R and 1B to the respective directions indicated by the arrows, and all three rasters 1R, 1B and 1G are converged on a line as shown in FIG. 3.

What should be noted here is that part of the leakage flux 8 from the deflection coil 7 passes by a location near the pole pieces 6. Namely, the magnetic field 8 passes through the pole pieces 6 having a small magnetic reluctance, forming a magnetic field shown by the arrows of solid lines in FIG. 2. This magnetic field, shown by the solid lines, virtually acts on only the central electron beam G, and consequently the horizontal raster 2G produced by the central beam G separates from the horizontal rasters 2B and 2R produced by the outermost beams B and R at the top and bottom of the screen, as shown in FIG. 4. The result is the creation of coma in the vertical direction.

The convergence correcting device arranged as described above is disclosed, for example, in Japanese patent examined publication No. 47-9939 filed on Mar. 13, 1968 in Japan. Another convergence correcting device is described in Japanese patent examined publication No. 50-27966 filed on Aug. 23, 1967 in Japan by General Electric Company under priority right based on U.S. patent application Ser. No. 574,411 filed on Aug. 23, 1966. This publication discloses the arrangement of a convergence yoke and pole pieces in combination for correcting mis-convergence of vertical rasters and another combination of a convergence yoke and pole pieces for correcting mis-convergence of horizontal rasters. The above invention has problems of the need of a large area for mounting two sets of convergence yoke and pole pieces, a complex structure and an increased number of component parts.

There has been proposed the provision of a shielding plate between the pole pieces 6 and the deflection yoke 7 with the intention of shielding the leakage flux from the deflection coil shown in FIG. 1. In this arrangement, however, the shielding plate provided at the rear end of the deflection yoke acts to cancel part of a leakage flux produced by the main winding of the horizontal and vertical deflection coils, which negates the contribution of the horizontal and vertical deflection magnetic fields in the rear of the deflection yoke to the deflection of the electron beams, resulting in a degraded horizontal and vertical deflection sensitivity and also in an increased pincushion distortion due to the shift of the deflection start point into the screen.

SUMMARY OF THE INVENTION

An object of this invention is to overcome the foregoing prior art deficiencies and provide a device for correcting the mis-convergence of vertical rasters without inviting coma in the vertical direction.

Another object of this invention is to provide a device for correcting the mis-convergence of vertical rasters without inviting the deterioration of the electron beam deflection sensitivity.

In order to achieve the above objectives, the present invention includes the provision of means for producing a magnetic field so that it cancels a magnetic field created horizontally between the pole pieces by the leakage flux from the deflection coil. Namely, this invention resides in a convergence correcting device for a cathode ray tube having coplanar in-line electron guns emitting electron beams to the screen and operating to deflect the electron beams using a magnetic field produced by the deflection yoke, the device comprising: pole piece means provided individually for the outermost electron beams and adapted to produce a magnetic field for imparting a horizontal deflection force to each of the electron beams; convergence yoke means disposed in close vicinity to the pole piece means and adapted to apply a magnetic flux produced by the convergence yoke to the pole piece means; first coil means wound on the convergence yoke and adapted to produce a first magnetic flux in the convergence yoke in response to a supply current, said first magnetic flux being applied to the pole piece means so as to produce a first magnetic field which imparts a horizontal deflection force to the outermost electron beams; second coil means wound on the convergence yoke and adapted to produce a second magnetic flux in the convergence yoke in response to a supply current, said second magnetic flux being applied to the pole piece means so as to produce a second magnetic field between the outermost pole pieces so that the second magnetic field acts to cancel a third magnetic field created between the outermost pole pieces by a third magnetic flux from the deflection coil; and means for supplying the currents to the first and second coil means.

DESCRIPTION OF THE PREFERRED EMBODIMENTS

Figure 1:
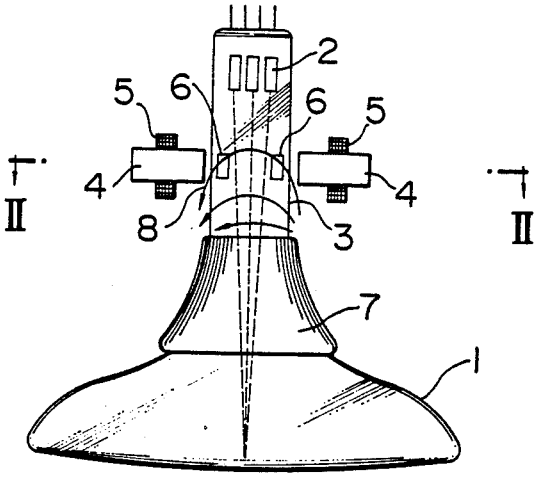
FIG. 1 (PRIOR ART)
FIG. 1 is a top view of a cathod ray tube having the conventional convergence correcting device.
Figure 5:
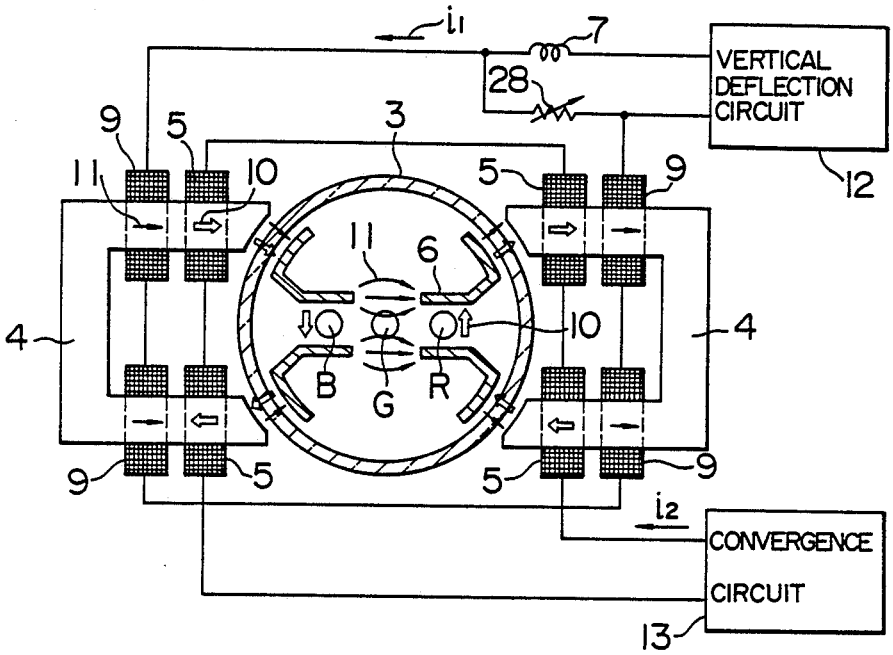
FIG. 5 is a schematic diagram showing an embodiment of the inventive convergence correcting device.

FIG. 5 shows the arrangement of the convergence correcting device embodying the present invention, in which component parts identical to those in FIG. 1 are referred to by the common symbols. In the figure, magnetic fields 10 shown by the bold arrows are 4-pole magnetic fields for horizontal convergence correction produced between the upper and lower pole pieces. The convergence correction magnetic fields 10 are produced by feeding a current $i_2$ to the convergence coils 5 which are wound on a pair of yokes 4. The current $i_2$ is supplied by a convergence circuit 13.

Figure 6:
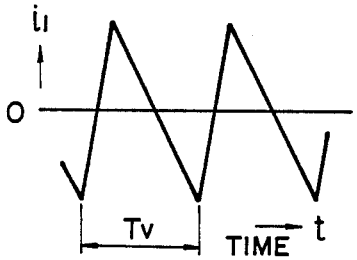
FIG. 6 is a waveform diagram showing the vertical deflection current.
Figure 7:
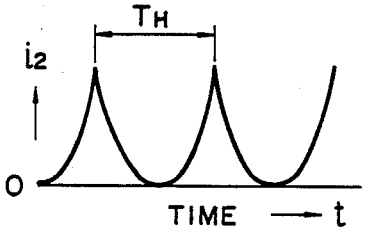
FIG. 7 is a waveform diagram showing the convergence current.

FIG. 7 shows the waveform of the convergence correcting current $i_2$. In the waveform diagram, symbol $T_H$ represents one horizontal scanning period, and the current waveform is parabolic in each period. The convergence coils 5 are wound on the yokes 4 so that the 4-pole magnetic fields shown in FIG. 5 are produced, and they are connected in series. Another set of coils 9 are wound on the yokes 4 with the intention of producing coma correcting magnetic fields 11 which act to cancel the leakage flux 8 (FIG. 2) from the vertical deflection coil 7. The coma correcting coils 9 are connected in series with the vertical deflection coil 7 to a vertical deflection circuit 12 which provides a vertical deflection current $i_1$ with a saw tooth waveform shown in FIG. 6, in which symbol $T_V$ represents one vertical scanning period. The coma correcting magnetic fields 11 act to cancel the magnetic field derived from the leakage flux 8 in the space between the right and left pole piece sets. The coma correcting circuit constitutes a serial circuit including the coils 9 wound on the yokes 4, with its one end connected through a variable resistor 28 to one end of the vertical deflection coil which is in connection with the vertical deflection circuit and another end connected directly to the vertical deflection circuit 12. The variable resistor 28 is used to adjust the current $i_1$, i.e., the magnitude of the coma correcting magnetic field 11, so as to cancel the leakage magnetic field 8 and eliminate coma.

Figure 8:
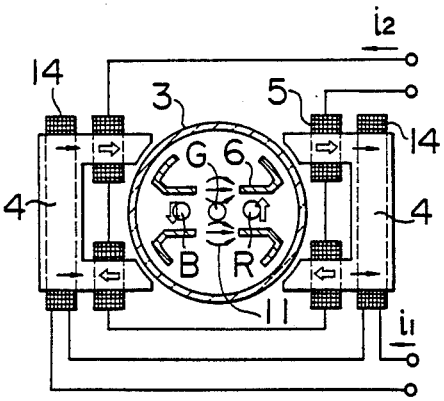
FIGS. 8, 9 and 10 are schematic diagrams showing the other embodiments of this invention.
Figure 9:
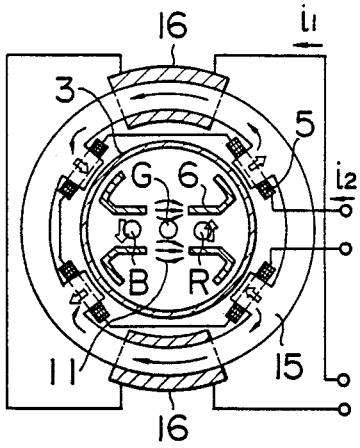
Figure 10:
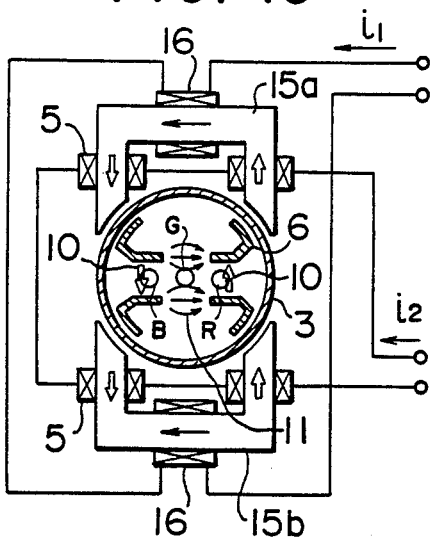

FIGS. 8, 9 and 10 show other embodiments of this invention, in which the component parts referred to by the same symbols are counterparts of FIG. 5. These embodiments differ from that of FIG. 5 in the structure of the convergence yoke and coma correcting coil. The embodiment of FIG. 8 has only one coma correcting coil 14 on each of yokes 4. The coils 14 are used to produce magnetic fields shown by the thin arrows in FIG. 8 so as to create a coma correcting magnetic field 11 in the space between the right and left pole piece sets. Currents $i_1$ and $i_2$ are supplied in the same way as of the embodiment of FIG. 5.

The embodiment of FIG. 9 has a single annular yoke 15, on which two coma correcting coils 16 are wound. Currents $i_1$ and $i_2$ are supplied in the same way as of the embodiment of FIG. 5, and the arrangement works in the same manner as of the embodiment of FIG. 8.

The embodiment of FIG. 10 resembles the embodiment shown in FIG. 9, but with the annular yoke in FIG. 9 being divided into upper and lower pieces 15*a* and 15*b*. The embodiments of FIGS. 5 and 8 form a magnetic path such that the magnetic flux (shown by thin arrows) of the coma correcting magnetic field 11 passes through the right-hand yoke, goes into the space and enters the left-hand yoke, whereas the embodiments of FIGS. 9 and 10 have the magnetic flux of the coma correcting magnetic field 11 passing inside the yoke throughout the path, resulting in a smaller magnetic reluctance and a larger magnetic flux density, whereby the number of turns of the coils can be reduced advantageously.

Figure 3:
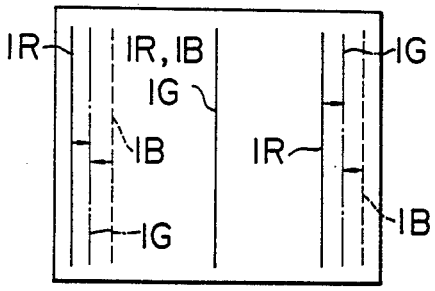
FIG. 3 is a diagram of vertical rasters on the screen, showing the convergence correction in the horizontal direction.
Figure 4:
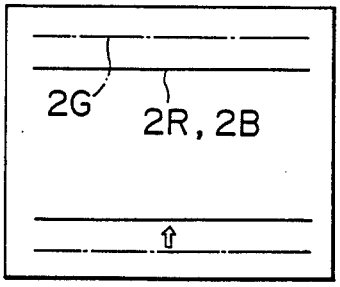
FIG. 4 is a diagram of horizontal rasters on the screen, explaining coma in the vertical direction caused by a leakage flux.
Figure 11:
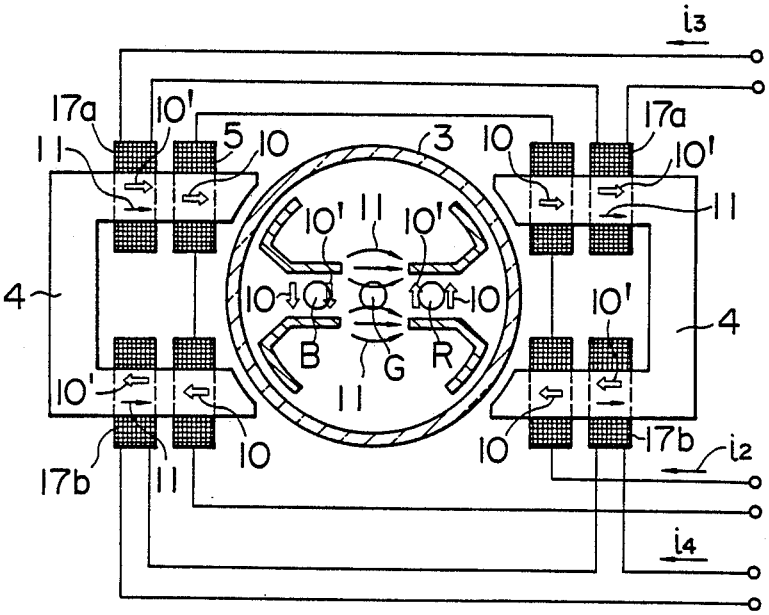
FIG. 11 is a schematic diagram showing still another embodiment of the inventive convergence device.
Figure 12:
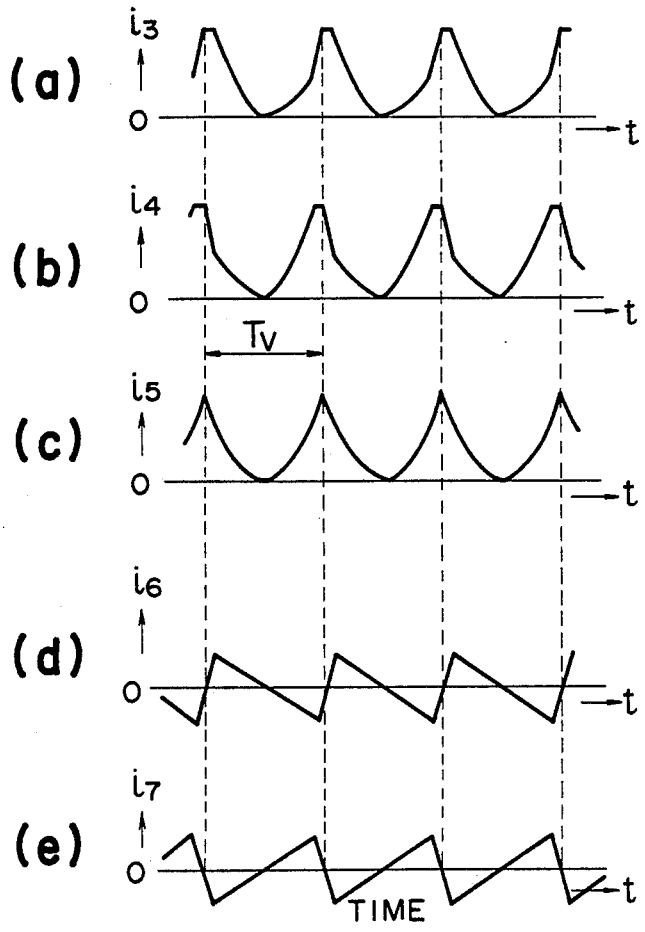
FIG. 12*a–e* are a set of waveform diagram showing the current waveforms observed in the embodiment of FIG. 11.
Figure 13:
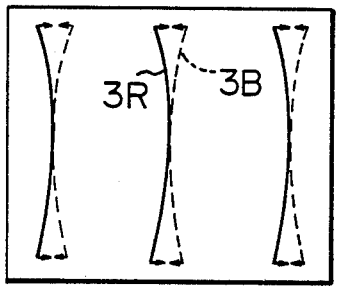
FIGS. 13 and 14 are diagrams showing separate cases of mis-convergence of vertical rasters.

The embodiment of FIG. 11 is intended to correct the arc mis-convergence of the vertical rasters 3R and 3B as shown in FIG. 13 without inviting the occurrence of coma. The embodiment differ from that of FIG. 5 in that the coma correcting coils 17*a* and 17*b* are energized by separate currents $i_3$ and $i_4$. FIG. 12 shows the waveforms of the coil currents. The convergence correcting coils 5 are supplied with the current $i_2$ (FIG. 7) for correcting the horizontal mis-convergence shown in FIG. 3, and 4-pole magnetic fields 10 are produced in the spaces between the upper and lower pole pieces. The coma correcting coils 17*a* and 17*b* are supplied with the currents $i_3$ and $i_4$ shown by (a) and (b), respectively, in FIG. 12. The current $i_3$ is the result of composition of a parabolic current $i_5$ shown by (c) in FIG. 12 and a saw tooth current $i_6$ shown by (d) in FIG. 12, and similarly the current $i_4$ is the result of composition of the parabolic current $i_5$ and a saw tooth current $i_7$ shown by (e) in FIG. 12. The following describes the magnetic field formation by the pole pieces when the above-mentioned currents are supplied to the coils.

Figure 14:
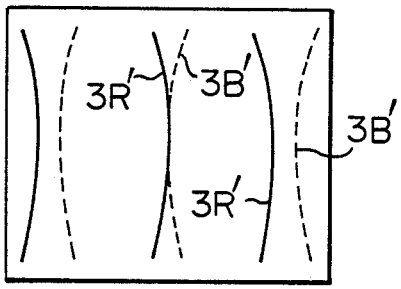

Initially, the current $i_3$ in the coil 17a can be decomposed into current components $i_5$ and $i_6$. The current component $i_5$, which is in a parabolic waveform, produces a magnetic field 10' acting on the rasters to move in the directions shown by the arrows in FIG. 13. The current $i_4$ in the coil 17b can be decomposed into current components $i_5$ and $i_7$. The current component $i_5$ in the coil 17b has the same effect as of the coil 17a. In consequence, the arc mis-convergence shown in FIG. 13 can be corrected using the magnetic fields 10' produced by the current components $i_5$ in the coils 17a and 17b. This means that the mis-convergence of vertical rasters as shown in FIG. 14 can be corrected using the composed magnetic fields produced by the coil 5 and coils 17a and 17b. Other current components $i_6$ and $i_7$ in the coils 17a and 17b, respectively, are equivalent to the current $i_1$ in the embodiment of FIG. 5, and the magnetic fields 11 produced by these components act to cancel the magnetic fields 8 (FIG. 2) caused by the leakage flux from the vertical deflection coil 7 and correct vertical coma.

Figure 15:
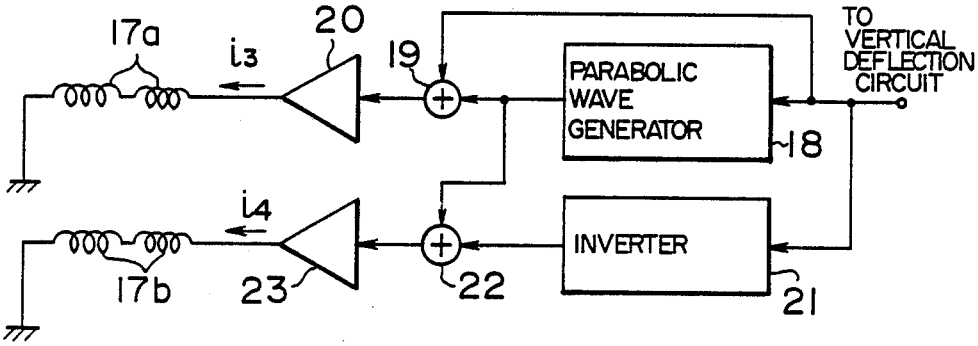
FIG. 15 is a block diagram of the current source circuit used in the embodiment of FIG. 11.

FIG. 15 shows an example of the currents $i_3$ and $i_4$ source circuit used in the embodiment of FIG. 11. A saw tooth wave signal with a period of $T_V$ from the vertical deflection circuit is applied to an adder 19 and a parabolic wave generating circuit 18. The parabolic wave generating circuit 18 produces a parabolic wave signal in synchronism with the original saw tooth wave signal having a period of $T_V$, and both the signals are added together by the adder 19. The resultant signal from the adder 19 is amplified by an amplifier 20, which then provides the current $i_3$. At the same time, the saw tooth wave signal from the vertical deflection circuit is fed to a phase inverting circuit 21, and the saw tooth wave signal with its phase inverted is produced. Another adder 22 is used to add the output of the phase inverting circuit 21 to the output of the parabolic wave generating circuit 18. The resultant signal from the adder 22 is amplified by an amplifier 23, which then provides the current $i_4$. The current source circuit shown in FIG. 15 can be configured using functional elements known in the art.

Figure 16:
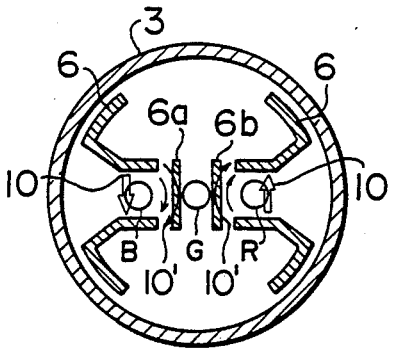
FIG. 16 is a partial structural diagram showing a further embodiment of the inventive convergence correcting device.

FIG. 16 shows another embodiment of this invention. In this convergence correcting device, magnetic members 6a and 6b are disposed in close vicinity to the pole pieces 6 on both sides of the central beam G. A new effect resulting from the addition of the magnetic members 6a and 6b is as follows. Between the upper and lower pole pieces 6, there exist magnetic fields 10' caused by the leakage flux from the upper and lower pole pieces of the 4-pole magnetic fields 10 used for convergence correction. The leakage magnetic fields 10' causes the central beam G to have its spot shape distorted. The magnetic members 6a and 6b employed in this embodiment act to shield the central beam G from the leakage magnetic fields 10' and prevent the beam spot from deformation.

Figure 17:
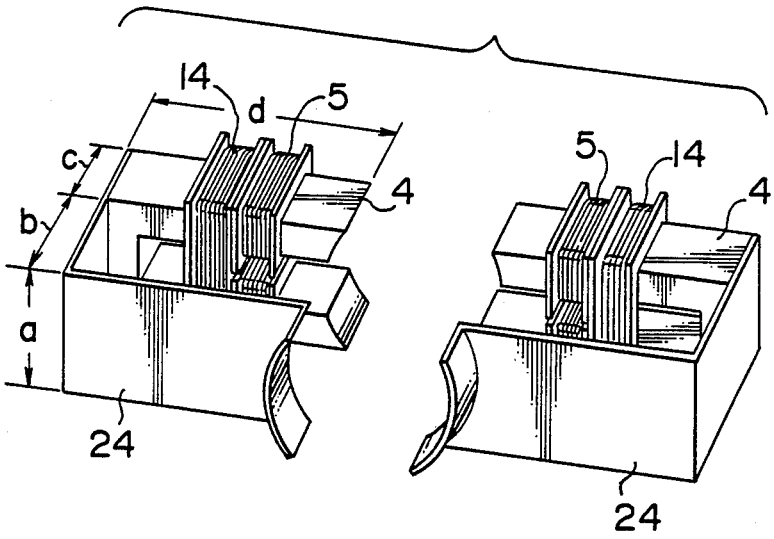
FIG. 17 is a partial perspective view of another embodiment of this invention.
Figure 18:
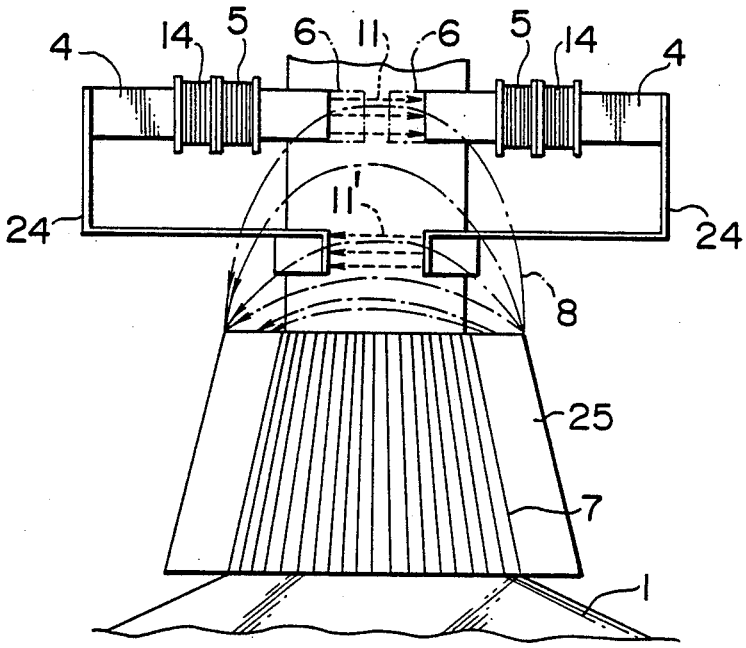
FIG. 18 is a top view of the embodiment shown in FIG. 17.

FIG. 17 shows still another embodiment of this invention, in which separate magnetic members 24 are further provided on the yokes 4 employed in the embodiments of FIGS. 5, 8 and 11. Namely, FIG. 17 is a perspective view of the yokes 4 in the embodiment of FIG. 8, on each of which an auxiliary magnetic member 24 is attached. The auxiliary magnetic members 24 are formed in an L shape, with their one ends held by the respective yokes 4 and another ends adapted to support the neck section 3 of the cathode ray tube 1. FIG. 18 gives a top view of the assembly of the yokes and auxiliary magnetic members in FIG. 17 attached to the cathode ray tube 1. The CRT screen is located at the bottom of the figure.

Figure 2:
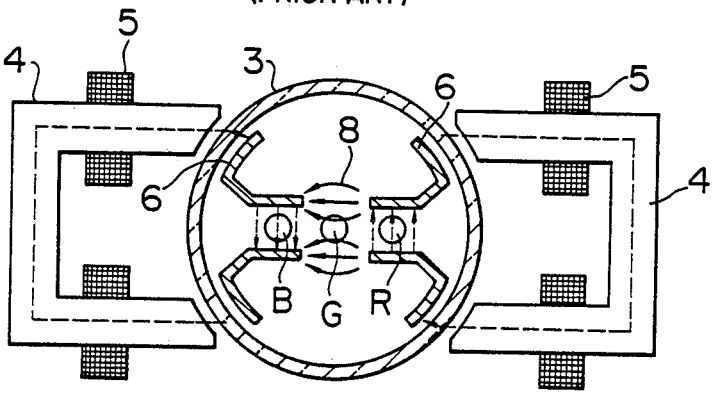
FIG. 2 (PRIOR ART)
FIG. 2 is a cross-sectional view of the cathode ray tube taken along the line II—II of FIG. 1.
Figure 19:
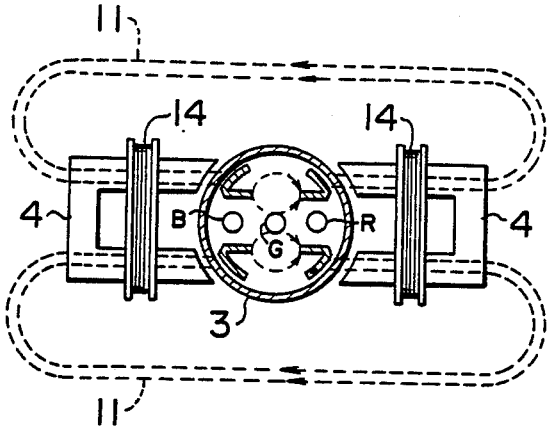
FIG. 19 is a diagram showing the magnetic path of the coma correcting magnetic field.

In operation, the deflection yoke 25 on which the vertical deflection coil 7 is wound creates the leakage flux 8 as has been described in connection with FIGS. 1 and 2, and it passes through the pole pieces 6 used for correcting mis-convergence. In order to cancel the leakage flux 8 passing though the pole pieces 6, coma correcting magnetic fields 11 in opposite directions are produced by the coils 14. In the embodiments of FIGS. 5, 8 and 11, the coma correcting flux 11 goes out of one yoke 4 into the space and then reaches another yoke 4 as shown in FIG. 19, and the magnetic flux returning from the space does not directly contribute to mis-convergence correction nor coma corrections. In contrast, the embodiment of FIG. 18 is intended to use the return flux effectively. The auxiliary members 24 attached to the yokes 4 in FIG. 18 are made of magnetic material with extremely small magnetic reluctance, and therefore they allow the passage of the whole return flux derived from the coma correcting magnetic field. Accordingly, the auxiliary members 24 at the portions supporting the tube neck section 3 have the return flux coincident in the direction with the leakage flux 8 from the vertical deflection coil 7, thereby acting to strengthen the deflection magnetic field. Consequently, this embodiment provides an enhanced deflection sensitivity as compared with the embodiments of FIGS. 5, 8 and 11, and in addition the shift of the beam deflection start point closer to the electron guns is effective for alleviating the vertical pincushion distortion.

Figure 20:
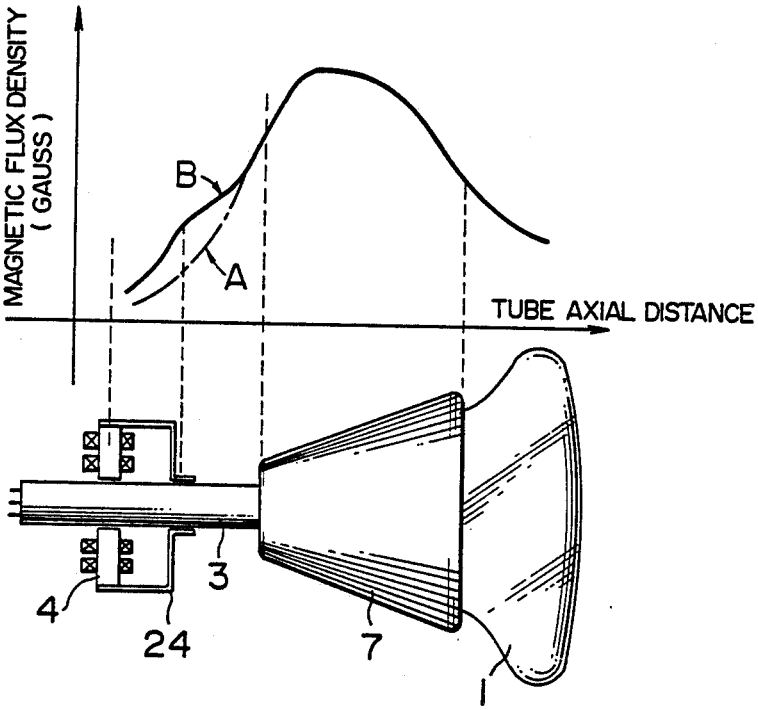
FIG. 20 is a graphical representation of the magnetic flux distribution plotted along the axial direction of the cathode ray tube according to the embodiment shown in FIG. 18.

FIG. 20 is a graphical representation comparing the flux density distribution of the vertical deflection magnetic field along the tube axial direction of the case where the auxiliary member 24 is attached to the convergence correcting device as in this invention and the case of the device without it as shown in FIG. 19. On the graph, the curve A represents the case without the auxiliary member 24, indicating that the coma correcting magnetic field 8 produced by the coil 14 cancels part of the vertical deflection magnetic field, with the result of a decreased flux contributing to the deflection. The curve B represents the case with the provision of the auxiliary member 24, and in this case the coma correcting magnetic field 8 has its magnetic path formed concentrically within the tube 1 so that the field acts as an auxiliary vertical deflection magnetic field which as a result improves the vertical deflection sensitivity and at the same time reduces the vertical pincushion distortion by moving the deflection start point toward the electron gun set. A further feature provided by the auxiliary member 24 is that the coma correcting magnetic field can efficiently be introduced into the cathode ray tube 1.

The foregoing embodiment of the invention was applied to a 29 inch-screen, in-line pole-piece color CRT having a deflection angle of 110° and major dimensions of a=28 mm, b=5 mm, c=8 mm and d=40 mm, as shown in FIGS. 17 and 18. The auxiliary member 24 is made of 1 mm thickness silicon steel plates, and the deflection yoke with a core length of 41 mm has a 280-turn vertical coil and a 90-turn convergence coil. The vertical deflection current is approximately 1.66 amperes peak-to-peak. With the above design condition, the application of the inventive device to the deflection yoke of a 10.5% (21 mm at top or bottom side) vertical pincushion distortion provided the effectiveness of a 14% (3 mm at top or bottom side) reduction in the pincushion distortion and a 15% improvement in the vertical deflection sensitivity as compared with the case without the auxiliary member.

Figure 21:
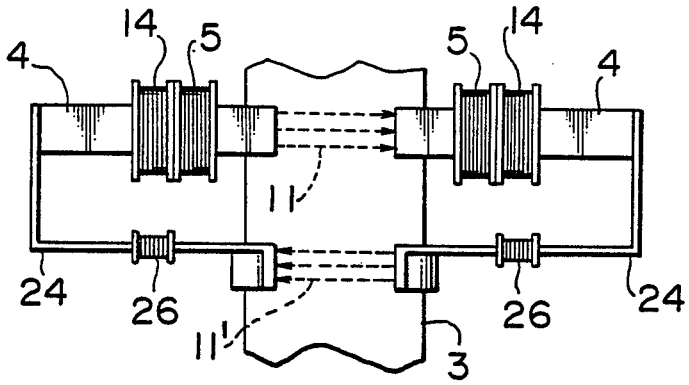
FIGS. 21 and 22 are partial structural diagrams showing further embodiments of this invention.

FIG. 21 is a plan view of the principal portion of another embodiment employing the auxiliary member. In this embodiment, auxiliary vertical coils 26 are placed in serial connection with the main windings of the vertical deflection coil 7 on the auxiliary member 24 provided for the convergence correcting device. The auxiliary vertical coil 26 serves to correct vertical coma and in addition augment the effectiveness of the previous embodiment shown in FIG. 18 by producing a magnetic field in the same direction as of the vertical deflection magnetic field.

Figure 22:
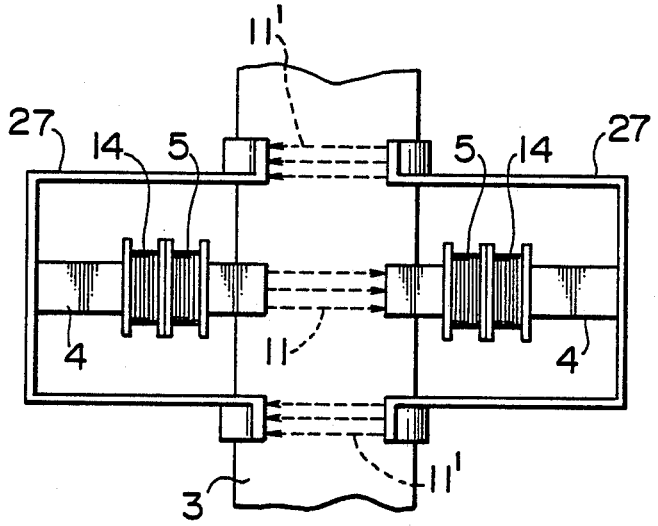

FIG. 22 is a plan view of the principal portion of still another embodiment of the invention employing the auxiliary member. In this embodiment, auxiliary members 27 provided for the convergence correcting device are disposed in U-shape configurations at the front and back of the yoke 4. This arrangement is effective for augmenting the effectiveness of the embodiment shown in FIG. 18.

We claim:

1. A convergence correcting device for a cathode ray tube having a plurality of coplanar in-line electron guns for emitting electron beams to a screen and operating to deflect the electron beams using a magnetic field produced by a deflection coil, said device comprising:

pole piece means provided individually for the outermost ones of said electron beams, said pole piece means comprising two pairs of upper and lower poles pieces in parallel with each other for producing a first magnetic field for imparting a horizontal deflection force to the outermost electron beams;

convergence yoke means disposed in close vicinity to said pole piece means for applying a magnetic flux produced in said convergence yoke means to said pole piece means;

first coil means wound on said convergence yoke means for producing a first magnetic flux in said convergence yoke in response to a supply current, said first magentic flux being applied to said pole piece means so as to produce said first magnetic field;

second coil means wound on said convergence yoke means for producing a second magnetic flux in said convergence yoke means in response to a supply current, said second magentic flux being applied to said pole piece means so as to produce a second magnetic field which affects a central electron beam and acts to cancel a third magnetic field created between said pole piece means by a third magnetic flux from said deflection coil which affects the central electron beam; and means for supplying current to said first and second coil means.

2. A convergence correcting device according to claim 1, wherein said convergence yoke means comprises two magnetic cores each having an end face close by the upper and lower pole piece pieces of said pole means, said second coil means being wound on each of said magnetic cores.

3. A convergence correcting device according to claim 1, wherein said convergence yoke means comprises an annular magnetic core having on the inner side thereof projections adjacent said pole piece means to pass a magnetic flux to said pole piece means, said first coil means being wound on said projections, said second coil means being wound on portions of said annular magnetic core other than said projections such that said second magnetic field for cancelling said third magnetic field is produced between said two pair of pole pieces.

4. A convergence correcting device according to claim 1, wherein said current supply means comprises a first current circuit for producing a saw tooth waveform current in synchronism with a vertical deflection signal and a second current circuit for producing a parabolic waveform current in synchronism with a horizontal deflection signal, said first current circuit being connected through said deflection coil to said second coil means, said second current circuit being connected to said first coil means.

5. A convergence correcting device according to claim 1, further comprising third coil means for producing a fourth magnetic field between said upper and lower pole pieces of each pair of pole piece means for correcting arc mis-convergence, said third coil means being wound on said convergence yoke and connected to a third current circuit which produces a parabolic waveform current in synchronism with a vertical deflection signal.

6. A convergence correcting device according to claim 5, wherein said third coil means comprises a coil shared with said second coil means, said third current circuit producing currents, as a result of composition of the parabolic waveform and saw tooth waveforms, in synchronism with the vertical deflection signal.

7. A convergence correcting device for a cathode ray tube having a plurality of coplanar in-line electron guns for emitting electron beams to a screen and operating to deflect the electron beams using a magnetic field produced by a deflection coil, said device comprising:

pole piece means provided individually for the outermost ones of said electron beams and adapted to produce a magnetic field for imparting a horizontal deflection force to the electron beams;

convergence yoke means disposed in close vicinity to said pole piece means and adaptped to apply a magnetic flux produces in said convergence yoke means to said pole piece means;

first coil means wound on said convergence yoke means and adapted to produce a first magnetic flux in said convergence yoke in response to a supply current, said first magnetic flux being applied to said pole piece means so as to produce a first magnetic field which imparts a horizontal deflection force to the outermost electron beams;

second coil means wound on said convergence yoke means and adapted to produce a second magnetic flux in said convergence yoke means in response to a supply current, said second magnetic flux being applied to said pole piece means so as to produce a second magnetic field between the outermost ones of said pole piece means so that the second magnetic field acts to cancel a third magnetic field created between the outermost pole piece means by a third magnetic flux from said deflection coil; and means for supplying the currents to said first and second coil means;

said convergence yoke means including a magnetic member which functions to pass the second magnetic flux through a neck section of said cathode ray tube other than said pole piece means, said magnetic member having one end coupling to said convergence yoke means and another end supporting said neck section located apart from said pole piece means.

8. A convergence correcting device according to claim 7, wherein said magnetic member is arranged to support said neck section at the front and back of said pole piece means.

9. A convergence correcting means according to claim 7, wherein a fourth coil means is wound on said magnetic member, said fourth coil means producing a magnetic field in a same direction as a vertical deflection magnetic field at a portion of said neck section which is supported by said another end of said magnetic member.

10. A convergence correcting means according to claim 1, wherein said upper and lower pole pieces are disposed in parallel with said coplanar in-line electron guns.

* * * * *